US005705058A

United States Patent [19]

Fischer

[11] Patent Number: 5,705,058

[45] Date of Patent: Jan. 6, 1998

[54] IN-POOL SKIMMER

[76] Inventor: Bruce Fischer, 77 Foxwood Rd., West Nyack, N.Y. 10994

[21] Appl. No.: 745,175

[22] Filed: Nov. 7, 1996

[51] Int. Cl.[6] ..... E04H 4/16

[52] U.S. Cl. ..... 210/169; 210/237; 210/242.1; 210/470

[58] Field of Search ..... 210/169, 232, 210/237, 238, 242.1, 470; 4/490, 496

[56] References Cited

U.S. PATENT DOCUMENTS

| | | | |
|---|---|---|---|
| 3,863,237 | 1/1975 | Doerr | 210/169 |
| 4,053,412 | 10/1977 | Stix | 210/169 |
| 4,089,074 | 5/1978 | Sermons | 210/169 |
| 4,369,109 | 1/1983 | Edge | 210/169 |
| 4,518,495 | 5/1985 | Harding | 210/169 |
| 4,822,487 | 4/1989 | Soich . | |
| 5,043,060 | 8/1991 | Brennan | 210/169 |
| 5,139,660 | 8/1992 | Lourie et al. | 210/169 |
| 5,167,805 | 12/1992 | Theiss | 210/169 |
| 5,276,989 | 1/1994 | Lumb et al. | 210/470 |
| 5,277,801 | 1/1994 | Lundquist | 210/169 |
| 5,422,001 | 6/1995 | Yagoda | 210/169 |
| 5,487,830 | 1/1996 | Huppert | 210/169 |

*Primary Examiner*—Neil McCarthy
*Assistant Examiner*—Theodore M. Green
*Attorney, Agent, or Firm*—Martin Parkinson

[57] ABSTRACT

An in-pool skimmer is disclosed for maintaining large area swimming pools and demarcated swimming areas free of offensive floating debris. PVC tubing interconnected in a water-proof manner, and having additional buoyancy floats attached, forms the frame for the skimmer netting. In place of traditional perimeter operation of a pool skimmer, the in-pool skimmer floats within the pool and is directed by an operator either walking behind or swimming behind the skimmer, guiding the skimmer with its convenient handles. When not in use the wedge shaped skimmer floats open side up, above the water, retaining collected debris within the netting of the skimmer.

9 Claims, 5 Drawing Sheets

IN-POOL SKIMMER

BACKGROUND

This invention relates to pool skimmers, and in particular to a pool skimmer that is operated from within a body of water, in contrast to traditional pool skimmers operated from the peripheral edges of a pool.

A common method today for removing leaves, insects, paper, and other objects floating on the surface of a pool is to employ a device resembling a butterfly net which an operator walking about the periphery of pool dips into the pool water to remove the unsightly debris. The prior art contains many suggested improvements. For example, Brennan, U.S. Pat. No. 5,043,060 teaches a triangularly shaped pool skimmer 10 (FIG. 1) having a front mounted tether 44 (FIG. 2) which enables an operator to drag the skimmer over the pool water while walking around the perimeter of the pool. The left and right sides of the skimmer may be equipped with brushes 23 (FIG. 3) to further aid pool cleaning procedures. Skimmer buoyancy is addressed, "The first two of these tubular members are air tight so that they have a tendency to float to the top of the water surface. The third tubular member has a plurality of apertures therein that allows it to fill with water and caused it to sink beneath the surface of the water.", abstract-lines 6–11. Similarly, Harding, U.S. Pat. No. 4,518,495, teaches a bridle 6 (FIG. 1) attached to a generally triangularly shaped skimmer 1 (FIG. 1) with side mounted floats 2 (FIG. 1) maintaining the skimmer in a horizontal position while being dragged over the surface of a pool by an operator walking along the perimeter of a pool. Again buoyancy is addressed by Yagoda, U.S. Pat. No. 5,422,001, who teaches a foam filled pelyvinylchlofide tube (col.4, lines 57–59) as a component of an enlarged pool skimmer 10 (FIG. 1) operated by means of an attached handle 66 (FIG. 1) which enables an operator walking about the periphery of a pool to move the skimmer over the pool surface. Sulch, U.S. Pat. No. 4,822,487, teaches using an elongated rectangular frame with a telescoping elongated handle to act as a pool skimmer 10 (FIG. 1) when moved by an operator about a pool periphery. Louria, U.S. Pat. No. 5,139,660, suggests a pool skimmer 10 (FIG. 1) spanning the width of a pool, utilizing two operators 18 (FIG. 1) to move the skimmer over the surface of a pool. Numerous other pool surface debris removing methods include filters placed on inlets or outlets of water flowing into or out of a pool in order to remove the aesthetically displeasing objects.

While the above described devices provide useful methods for cleaning the surface of a swimming pool from floating debris, they do not address the problem of providing rapid, efficient, and economical debris removal in large pools and bodies of water wherein perimeter operation of a skimmer would be difficult or impossible.

Therefore it is a primary object of the invention to provide an economical and efficient pool skimmer for large area swimming pools.

It is a further object of the invention to provide a pool skimmer that does not require operation from the perimeter of a swimming pool.

Still another object of the invention is to provide a pool skimmer that can be utilized by an operator either walking or swimming behind said skimmer.

An additional object is to provide a pool skimmer which retains debris when not in operation.

Still another object of the invention is to provide a pool skimmer for a water front, perimeterless, demarcated swimming area.

A further object of the invention is to provide safe, efficient pool skimming operations with swimmers being present during the skimming procedure.

An additional object of the invention is to provide a pool skimmer that is simple and economical to fabricate.

SUMMARY

These and other objects are accomplished with the in-pool skimmer of the instant invention.

As has been noted above, unsightly debris floating on the surface of a swimming pool is most often removed by an operator walking along the pool perimeter and utilizing a device resembling a butterfly net attached to a pole to be dipped periodically in the water, thereby removing the debris. Additionally, more elaborate skimmers have been noted also requiring attachment to or operation from the perimeter of a pool. While these devices and methods generally suffice for home swimming pools and the like, in the case of large municipal swimming pools effective skimming becomes difficult or even impossible to be performed. And for water front areas demarcated for swimming, a perimeter doesn't even exist.

For these large area swimming pools it occurred that placing a suitable pool skimmer within the pool to be directed from behind by an operator, such as, for example, a life guard, would provide a simple solution to this problem. The operator, free from the constraints of the pool perimeter, can direct the skimmer towards contaminated areas while avoiding obstructions such as ladders, floats, and the like typically present in most swimming pools. The "in-pool" skimmer can be directed with precision, obviating the necessity of having swimmers warned away from areas to be skimmed with less reliably directed skimmers. In shallow water the operator can simply walk behind the skimmer, and in deep water the operator swims behind the skimmer while directing it to areas containing floating debris.

In a first version of the invention 1¼" O.D. polyvinylchloride tubing was used to form a generally wedge shaped skimmer. Two approximately 1' lengths of PVC tubing and one approximately 1¾' length of PVC tubing form a triangularly shaped left side of the skimmer, and three similar lengths of PVC tubing form a triangularly shaped right side of the skimmer. Three approximately 5' lengths of this same O.D. PVC tubing are laterally spaced between the left and right triangularly shaped sides of the skimmer, interconnecting the sides together to form a substantially wedged shaped frame. Standard available PVC elbows and tees are employed to adhesively secure the three 5' long PVC tubes and 6 shorter PVC tubes together in a water tight engagement at each of the three angles within each of the triangularly shaped sides. Alternatively, PVC connectors can be specially molded in order to make these tubing connections. An obtuse angle of approximately 120° has been found useful in constructing the base portion of each of the triangular sides. The wedge shape is now comprised of a left side frame, a tight side frame, with a first lateral frame and a second lateral frame extending upwards from the base portion of the two skimmer sides, defining a large mouth opening to the skimmer. Strips of a hook and loop fastener, such as VELCRO® (a registered trademark of VELCRO USA) provide the means for connecting a fine mesh net to the open areas defined by the left and right side frames of the skimmer, and the first and second lateral frames extending therebetween.

This substantially wedged shaped frame with net will now float on the surface of a pool with the PVC tube which forms the base portion of the wedge, and the major portion of the first and second lateral frame sides submerged in water, with the mouth opening to the skimmer tiding above the water level in the pool. The skimmer in this configuration can now be used by an operator within the pool by simply grasping a top edge of the first lateral frame or a top edge of the second lateral frame, and then pushing the frame and net over the surface of the water. However, this maneuver is cumbersome, so a pair of handles was added to enable the operator to have precise control over the skimmer. The handles are hemispherically bent PVC tubes adhesively attached to the top edge of the first lateral frame to provide a convenient left and right hand grip for the operation, and to give the operator a convenient handle shape to direct the mouth of the skimmer for skimming procedures while walking behind the skimmer in shallow water, or while swimming behind the skimmer in deep water.

A further aid to comfortable operation of the skimmer was found by adding floatation aids to the skimmer. This consists of connecting one or more blocks of polyethylene foam to the middle portion of the three arms comprising the left and right frame sides of the skimmer as well as the base PVC tube and the PVC tube which forms the top edge of the second lateral frame. Placing floatation devices on these sections of the skimmer greatly facilitates ease and convenience for operator direction of the skimmer.

Finally, adding a fourth 1' long PVC tube to the structure of each side frame of the skimmer so that each side frame is in the form of a parallelogram, with a fourth 5' long PVC tube now interconnecting each of the two top front edges of the parallelogram shaped sides of the skimmer add a convenient front placed handle for moving the skimmer into and out of a pool as required. This parallelogram area configuration of each side can be enclosed with netting for increased skimmer efficiency.

To utilize the skimmer the operator simply grasps the curved handles on the skimmer and causes the top edge of the second lateral frame to be dipped forward beneath the surface of the pool water so as to perform its function of effective skimming. While swimming behind the skimmer in deep water, the operator simply grasps a lower portion of each handle to increase the angle of water immersion of this second frame front edge. When not being used, the in-pool skimmer can simply be left to float, maintaining the debris within the confines of the skimmer. To clean the skimmer, it is simply removed from the pool and rinsed with a hose.

While the in-pool skimmer of the invention has been described as being fabricated out of adhesively secured PVC tubing for convenience of manufacture, obviously other suitable plastic materials can be employed, and other fabrication techniques, such as, for example, threading tubing together or securing tubing together with suitable nuts and bolts. Skimmer netting has been described as being connected to the skimmer frame by means of strips of VELCRO® for convenient removal when necessary. Obviously the netting can also be connected to the skimmer frame in a variety of other methods for either permanent or removable connection. Similarly the skimmer of the invention has been described as being substantially triangular in shape, or having the shape of a parallelogram. Obviously other shapes including curved members, polygons, etc., can be substituted for the described embodiments of the instant invention without departing from the scope of the disclosure.

Thus a new convenience in large area swimming pool skimming procedures is provided. The described in-pool skimmer, placed within a pool, provides an economical and efficient method for rendering municipal swimming pools and other large area swimming facilities free of offending floating debris with new ease and simplicity heretofore impossible to achieve with traditional perimeter operated skimming procedures.

DETAILED DESCRIPTION

Figure 1:
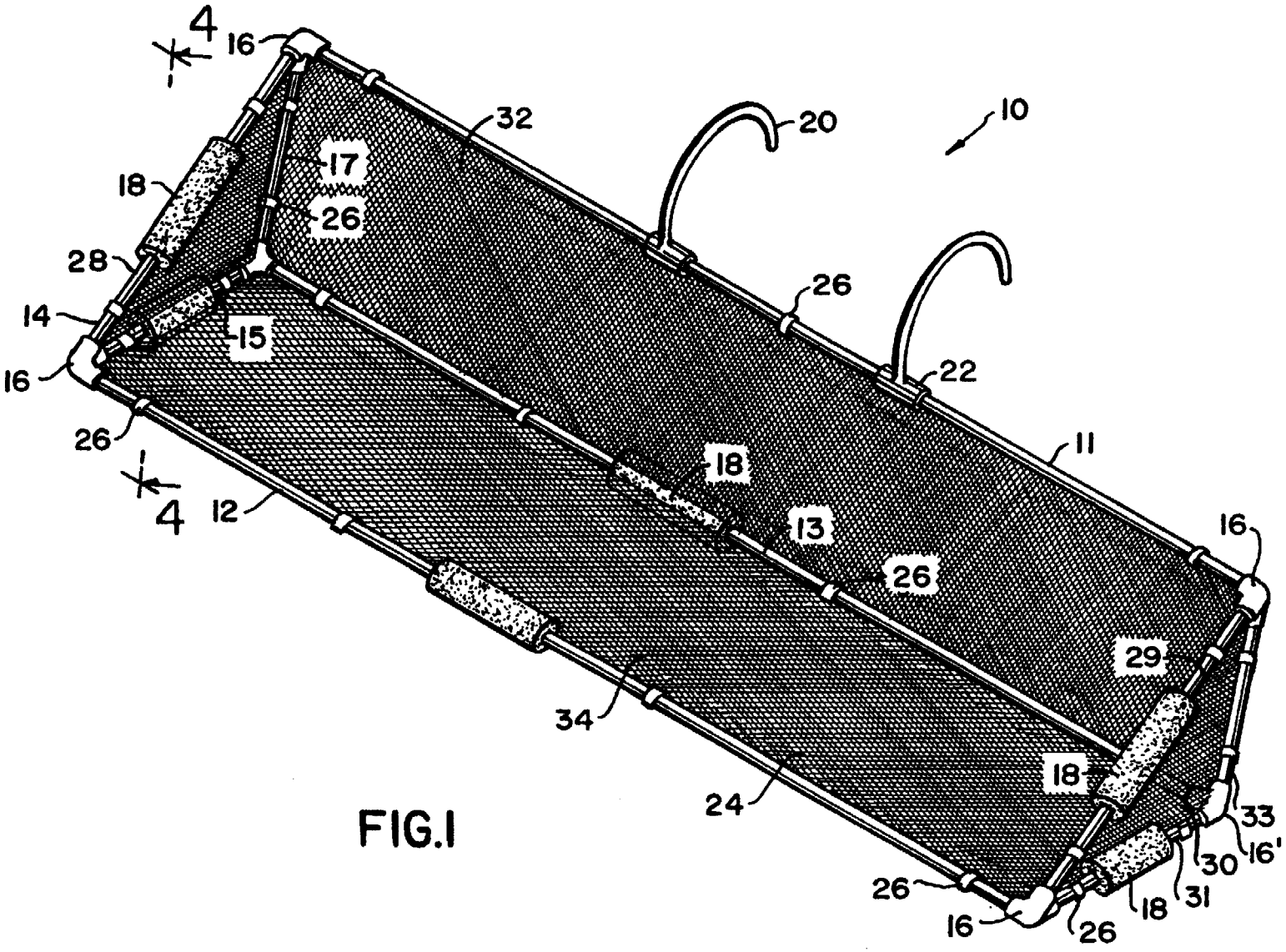
FIG. 1 is a perspective view of a first version of the invention.
Figure 4:
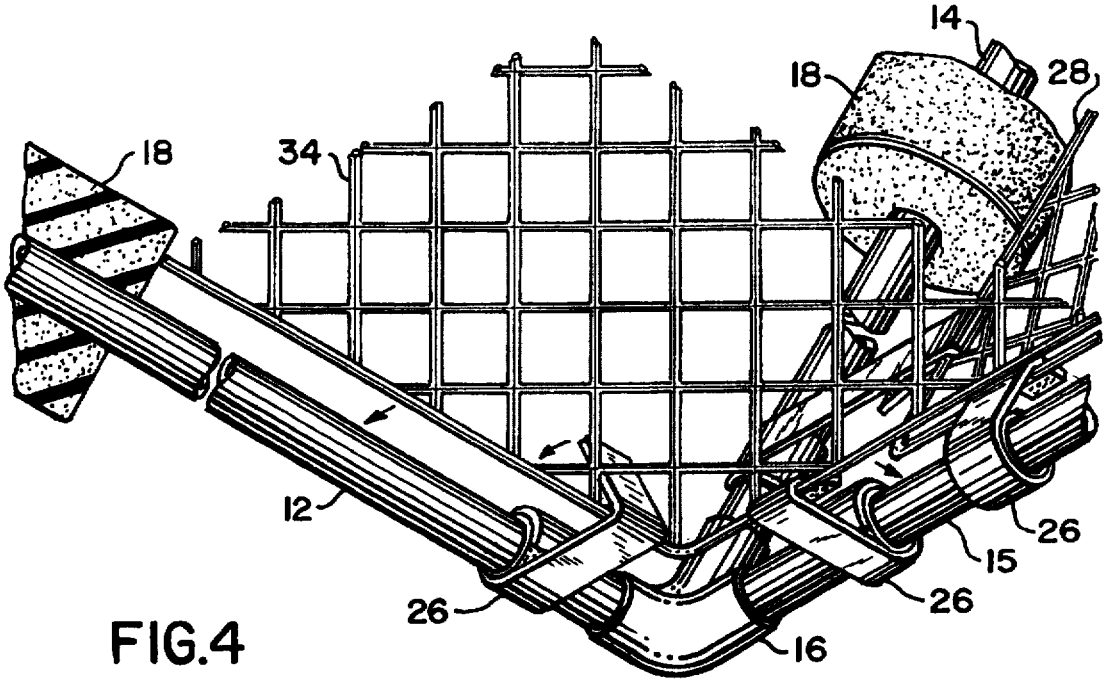
FIG. 4 is an enlarged view taken along the line 4—4 of FIG. 1, illustrating the net being connected to the skimmer frame by means of strips of hook and loop fasteners.

Turning now to the drawings wherein similar structures having identical functions are denoted with the same numerals throughout the various views, in FIG. 1 a first version 10 of the in-pool skimmer of the invention is shown. For convenience and economy in manufacture the in-pool skimmer is fabricated for the most part out of polyvinylchloride (PVC) tubing, but obviously a variety of other suitable materials can be similarly employed. Three approximately 5' long, 1¼" O.D. PVC tubes 11, 12, 13 form the lateral frames of the skimmer, and four approximately 1' long, 1 ¼" O.D. PVC tubes 15, 17, 31,33 and two approximately 1¾' long, 1¼" O.D. PVC tubes 14, 29 form the left 28 and right 30 sides of the skimmer. Standard PVC elbows and tees can be used to interconnect the 5' and shorter tubes together, but preferably specially molded three way PVC connectors 16, 16' provide the means for joining the tubes together to form the structure of the skimmer. Both the left 28 and right 30 sides of the skimmer 10 are triangular is shape, with the left frame side being formed by three arms 14, 15, 17 joined together by means of three PVC connectors 16, 16', and with the right frame side being formed by three arms 29, 31, 33 joined together by means of three PVC connectors 16, 16'. The two frame sides are interconnected to form the wedge shape of the skimmer by the three 5' length 11, 12, 13 of PVC tubing, each tube connecting at its respective ends to a PVC connector at each of the matching comers of the triangularly shaped sides of the skimmer. In addition to the two sides, the resulting wedged shaped frame has a first lateral frame 32 defined by a base 5' tube 13, and top edge 5' tube 11, and a left side frame triangular member 17, and a right side frame triangular member 33, and a second lateral frame 34 defined by a base 5' tube 13, a top edge 5' tube 12, and a left side frame triangular member 15, and a right side triangular member 31. As best seen in FIG. 4 a fine mesh net is affixed to the areas defined by the side and lateral flames by hook and loop fasteners 26 (such as VELCRO® fasteners) affixed to the net and the tubing forming the side and lateral frames. The 5' and 1' and 1¾' lengths of tubing comprising the skimmer frame are adhesively secured to the three way PVC connectors 16, 16' so as to form a water tight seal. Two handles 20 are affixed to the top edge 11 of the first lateral frame 32 by means of as specially molded PVC connector 22 affixed to this top edge. The handles can be fabricated out of PVC tubing. For convenient manipulation of the skimmer, the handles can be bent into a substantially hemispherical shape. While the in-pool skimmer of the invention will float as described and constructed above, it has been found that adding additional buoyancy, such as polyethylene foam blocks 18 being affixed to the arms of the side frames and lateral frames greatly facilitates operator (49-FIG. 3) ease and convenience in directing the movements of the skimmer.

Figure 1A:
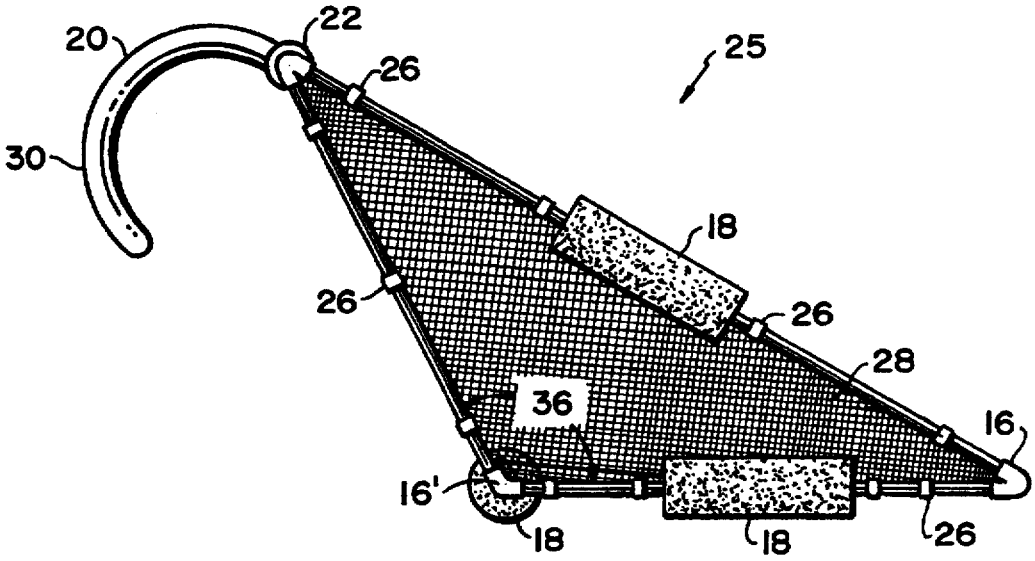
FIG. 1A is a side, elevational view of the first version of the invention depicted in FIG. 1.
Figure 1B:
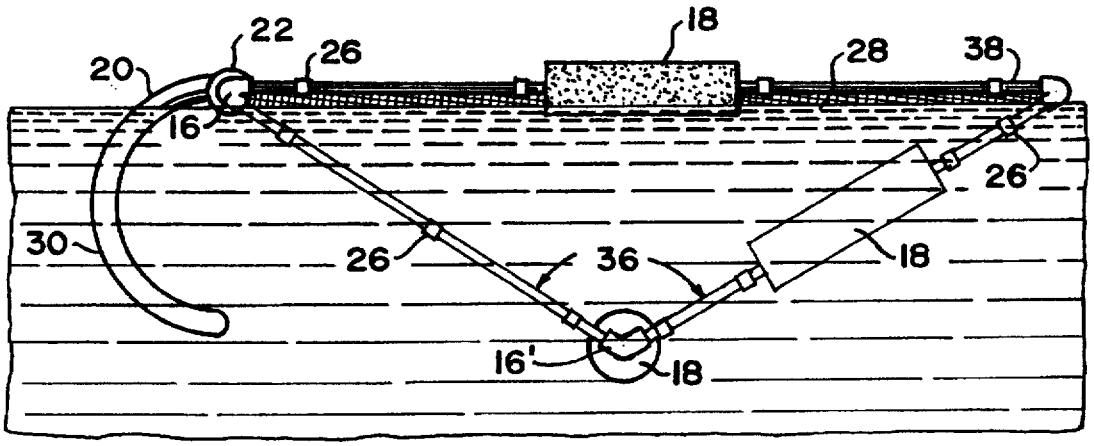
FIG. 1B is a side, elevational view of the first version of the invention of FIG. 1 shown floating in a swimming pool.

FIG. 1A illustrates a convenient structure for the triangularly shaped sides 28, 30. The left side 28 of the skimmer is shown having a greater than 90° obtuse angle 36° of approximately 120° being formed at the triangular corner wherein 1' long members 15 and 17 are joined with 5' long base member 13. An identical structure is formed on the right side 30 of the skimmer with 1' long members 31 and 33 and 5' long base member 13. This structure provides a convenient, large mouth opening 25 to the skimmer which can be easily manipulated by the operator 49. As best seen in FIG. 1B when the skimmer is not in operation it can simply float in the pool water with the open mouth 25 of the skimmer riding above the water line, thereby permitting the skimmer to retain any debris that has previously been collected in the skimmer 10.

Figure 2:
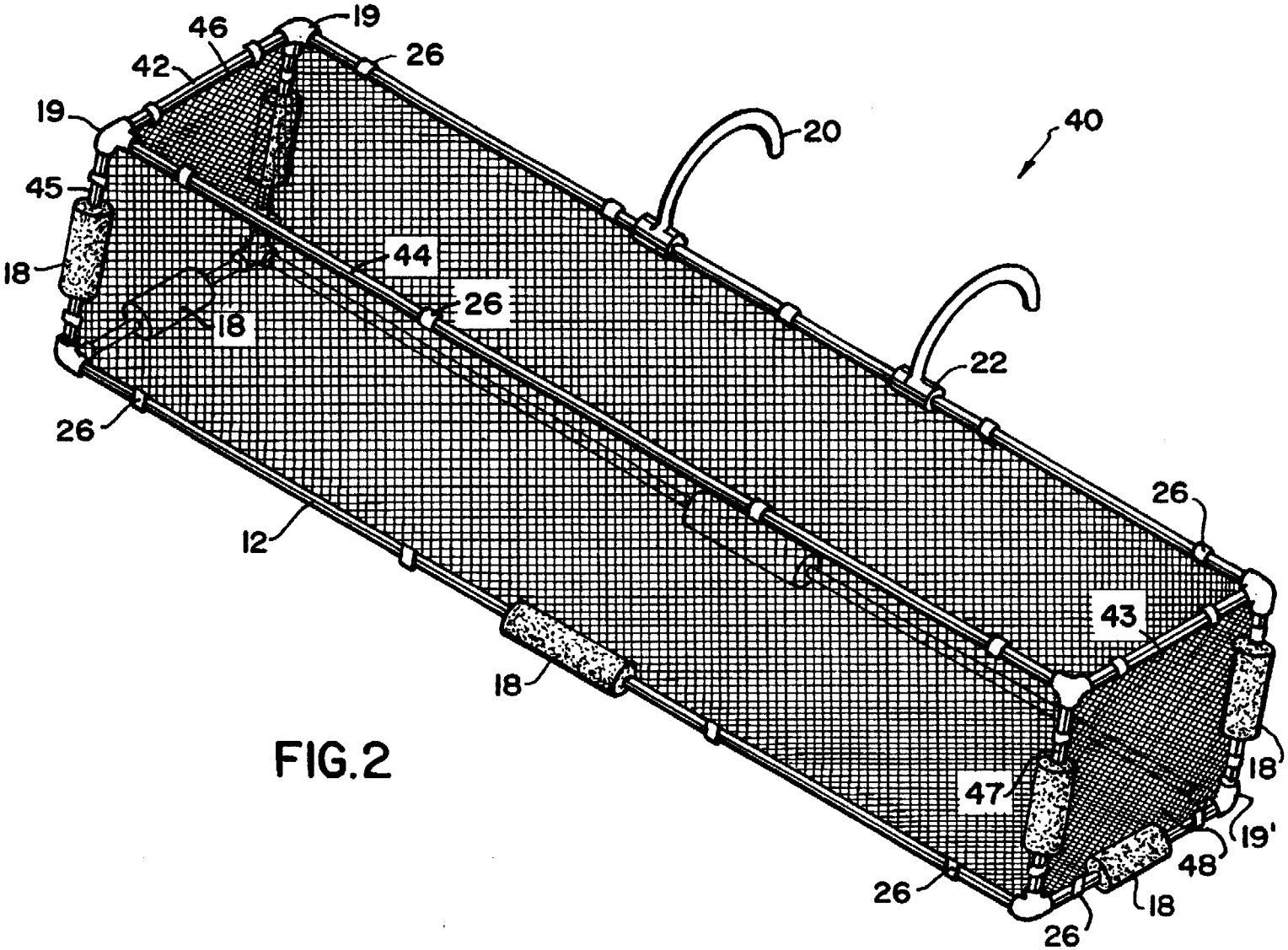
FIG. 2 is a perspective view of a second version of the invention.
Figure 2A:
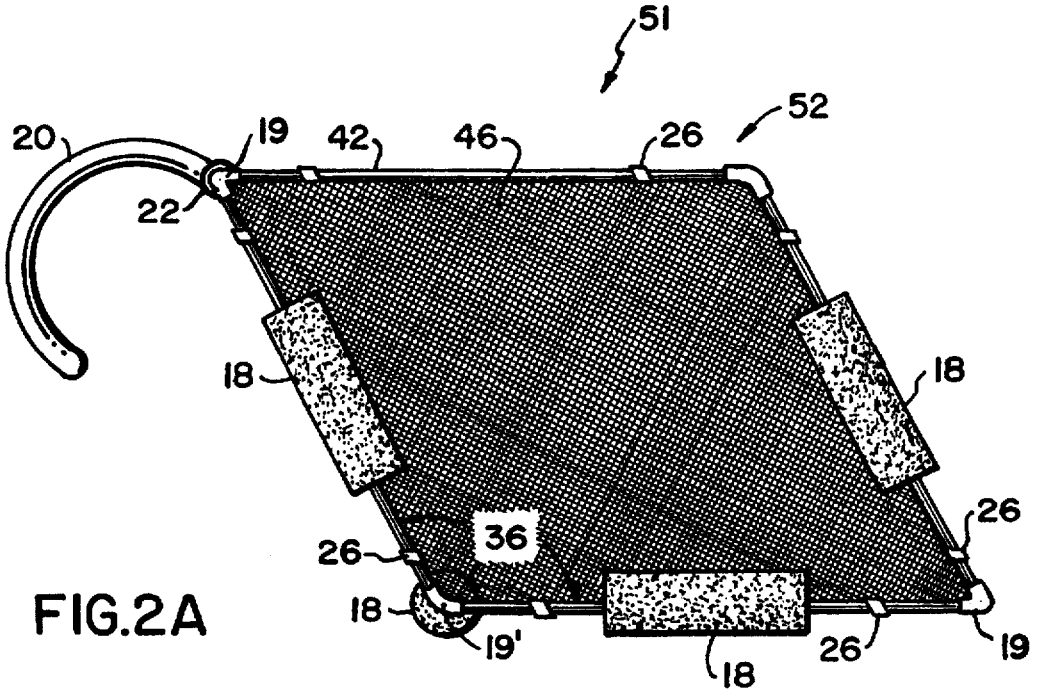
FIG. 2A is a side, elevational view of the second version of the invention depicted in FIG. 2.

In FIG. 2 a second version 40 of the in-pool skimmer is shown. Both the left side 46 and the right side 48 of the skimmer 40 are now substantially in the form of a rhomboid parallelogram. The left side 46 of the skimmer 40 is now comprised of 1' members 15 and 17 still subscribing an approximate 120° angle (FIG. 2A) as previously shown in the first version skimmer 10, with two new 1' members 42, 45 interconnected by means of specially molded 3 way PVC connectors 19, 19', with a similarly structured right side 48 having two new 1' members 43, 47 completing the parallelogram structure. An additional 5' long PVC tube 44 is added connected at its respective ends to the matching top front edge obtuse angle comers of the parallelogram shape of each of the skimmers sides. Both the left side 46 and right side 48 are covered with net as was the case with the triangularly shaped first version skimmer, with the previously described first lateral side 32 and second lateral side 34 being covered with net 24. This second version of the skimmer 40 floats when not in use in the same manner as described for the first version of the invention, and is maneuvered by the operator 49 with the same ease and facility, but now provides an additional handle for convenient movement of the skimmer into and out of a swimming facility as required.

Figure 3:
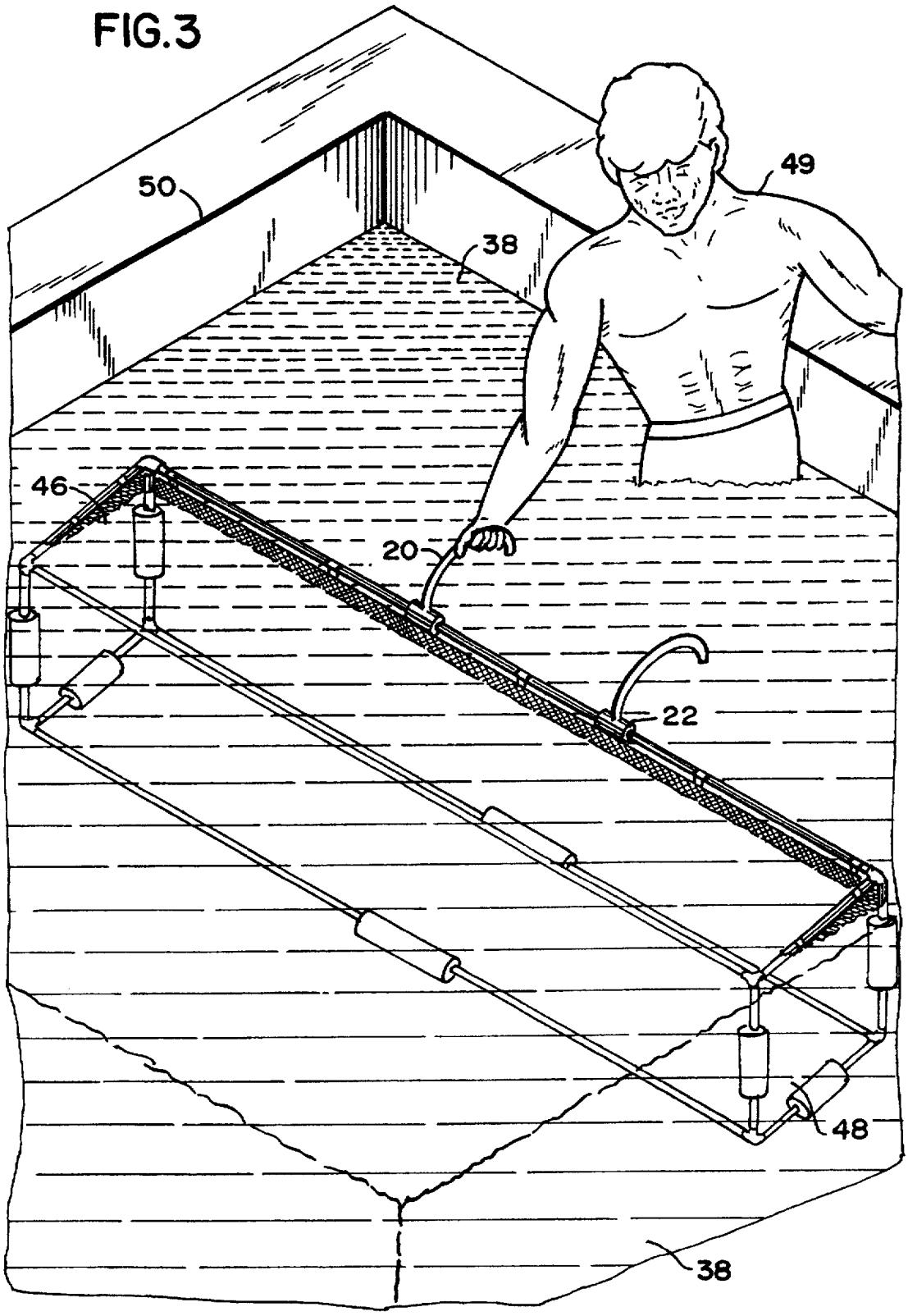
FIG. 3 is a perspective view of the second version of the invention depicted in FIG. 2 shown in use as being directed in movement by an operator immersed in a swimming pool.

FIG. 3 illustrates the second version in-pool skimmer 40 of the invention being used in a swimming pool. The operator 49 easily moves the skimmer over whatever areas of the pool water surface 38 requiring skimming, and with complete freedom from the constraints of a pool perimeter 50. The operator simply walks behind the skimmer in shallow water, or swims behind the skimmer while collecting offending floating debris within the skimmer. The in-pool skimmer can be left unattended in the pool and will float with the open mouthed areas 51,52 of the skimmer riding above the surface of the pool water, thereby maintaining the collected debris within the skimmer. To clean the skimmer it is simply grasped by the lateral extending front PVC tube 44, removed from the pool, and rinsed with a hose.

While versions of the present invention have been shown in detail, various modifications and improvements thereon will become readily apparent to those skilled in the art. Accordingly, the spirit and scope of the present invention is to be limited only by the following claims.

What is claimed is:

1. An in-pool skimmer for removing floating debris from the surface of a body of water, comprising:

(a) a frame;

(b) said frame having a base portion, a left side, a right side, a first lateral side extending from said left side to said right side, a second lateral side extending from said left side to said right side;

(c) a fine mesh material being affixed to said sides of said frame so as to cover said sides of said frame;

(d) said covered sides defining an open top portion, said open top portion having an opening a spaced distance between a top edge of said first lateral side and a top edge of said second lateral side, said opening extending the complete distance between said left side and said right side;

(e) said open top side of said frame being open to the ingress of debris contaminated water;

(f) said frame being buoyant so as to partially float in said body of water when said frame is placed in said water, so that said open top side of said frame remains above said surface of said water in said body of water; and (g) said frame having a pair of handles affixed to said top edge of said first lateral side so that an operator immersed in said water can conveniently orient said open top side of said frame in order to direct said ingress of said debris contaminated water into said opening in said top side, and move said frame over said surface of water so that said floating debris is collected on said fine mesh material within said skimmer.

2. The in-pool skimmer according to claim 1 wherein each of said handles extend rearward of said frame, said handle being substantially hemispheric in shape.

3. The in-pool skimmer according to claim 1 further comprising buoyant floats attached to said frame so as to additionally add to said buoyancy of said frame.

4. The in-pool skimmer according to claim 1 wherein said left side and said right side of said frame are triangular in shape.

5. The in-pool skimmer according to claim 4 wherein the angle of said triangular shape adjacent said base of said frame is at least 90°, said angle defining the width of said opening in said open top side of said frame.

6. The in-pool skimmer according to claim 5 wherein said angle is a minimum of 120°.

7. The in-pool skimmer according to claim 1 wherein said left side and said right side of said frame are substantially in the shape of a rhomboid parallelogram, and further comprising a third lateral side extending between said left side and said right side, said third lateral side having said fine mesh affixed thereto, said first lateral side and said third lateral side defining an open top portion in said skimmer, said open top portion having an opening a spaced distance between said top edge of said first lateral side and a top edge of said third lateral side, said opening extending the complete distance between said left side and said right side of said skimmer.

8. The in-pool skimmer according to claim 1 wherein said frame is fabricated from sections of PVC tubing waterproof interconnected so as to be buoyant in said water.

9. The in-pool skimmer according to claim 8 wherein said sections of said PVC tubing are adhesively secured together.

* * * * *